US007896986B2

(12) United States Patent
Kottilingam et al.

(10) Patent No.: US 7,896,986 B2
(45) Date of Patent: Mar. 1, 2011

(54) HEAT TREATMENT OF SUPERALLOY COMPONENTS

(75) Inventors: Srikanth C. Kottilingam, Orlando, FL (US); Peter J. Ditzel, Orlando, FL (US)

(73) Assignee: Siemens Energy, Inc., Orlando, FL (US)

( * ) Notice: Subject to any disclaimer, the term of this patent is extended or adjusted under 35 U.S.C. 154(b) by 863 days.

(21) Appl. No.: 10/932,718

(22) Filed: Sep. 2, 2004

(65) Prior Publication Data

US 2006/0042729 A1 Mar. 2, 2006

(51) Int. Cl.
*C22F 1/10* (2006.01)

(52) U.S. Cl. ..... 148/675; 148/562; 228/119; 29/889.7

(58) Field of Classification Search ..... 148/672, 148/675

See application file for complete search history.

(56) References Cited

U.S. PATENT DOCUMENTS 5,189,279 A * 2/1993 Foster et al. ..... 219/137 R
5,822,852 A * 10/1998 Bewlay et al. ..... 29/889.1
5,897,801 A * 4/1999 Smashey et al. .... 219/137 WM
6,145,194 A * 11/2000 Munson et al. ..... 29/889.1
6,503,349 B2 * 1/2003 Pietruska et al. ..... 148/562
2005/0194363 A1 * 9/2005 Hu et al. ..... 219/121.64

OTHER PUBLICATIONS

David A Deantonio et al., "Heat Treating of Superalloys" ASM Handbook, vol. 4, pp. 793-814, 1995.*

* cited by examiner

*Primary Examiner*—Roy King
*Assistant Examiner*—Christopher Kessler

(57) ABSTRACT

An improved method of heat treating superalloys prior to welding includes subjecting only the portion of the component to be repaired to a localized heat treatment, leaving the remainder of the component untreated. The localized heat treatment permits the use of higher hold temperatures that are near, at, or above the $Ni_3(Al,Ti)$ solution temperature of the alloy. Such heat treatment prevents strain age cracking and also prevents recrystallization in areas that are not heat treated. Such localized heat treatment can be applied before and/or after welding, for material rejuvenation, pre-brazing, and post-brazing.

7 Claims, 4 Drawing Sheets

HEAT TREATMENT OF SUPERALLOY COMPONENTS

BACKGROUND OF THE INVENTION

1. Field of the Invention

The present invention relates to a method of repairing superalloy components. More specifically, the invention provides a method of local heat treatment of superalloy components prior to welding in a manner that resists recrystallization of the material in locations where repair is not necessary, and also resists cracking in the heat affected zone of the weld and deposited weld metal while preserving the material properties of the remainder of the component.

2. Description of the Related Art

Components of various types of equipment that are subject to high temperature, high stress environments, for example, components within combustion turbines, are typically made from materials known as superalloys, which are defined herein as nickel based alloys containing aluminum and/or titanium, or cobalt based alloys. Components made from these materials typically include equiaxed materials, directionally solidified materials, or single crystal materials. After casting, the components are typically subjected to various heat treatments, for example, homogenization, hot isostatic pressing, solutionizing, and/or aging. The heating rate, hold temperature, hold time, and cooling rate of these heat treatment processes are intended to produce optimally sized and shaped grains of precipitate of $Ni_3(Al,Ti)$ and carbides within the material. The volume percentage, size, and distribution of these precipitates, along with the type and distribution of the carbide, determine the mechanical properties of the material. An optimum volume percentage and distribution of precipitates is the source of the material's high temperature strength.

During the operation of a combustion turbine having such components therein, the high temperature and stress to which the components are subjected cause precipitation of carbides in the grain boundaries in equiaxed and directionally solidified materials, and also causes coarsening of the $Ni_3(Al,ti)$ precipitates, thereby changing the mechanical properties of the material. Prolonged exposure to such conditions may cause cracking within the material.

Such cracks are typically repaired by welding, however, superalloys are difficult to weld. During welding, hot cracking may occur in the heat affected zone due to liquation of low melting phases such as borides, carbides, sulfides and/or phosphides in the grain boundaries. Present efforts to reduce hot cracking include design of the weldments, controlling trace elements within the base metal, using lower strength weld filler metals, and using welding processes with low heat inputs.

Additionally, post weld heat treatment cracking, also known as "strain age cracking," may occur during the post weld heat treatment which is performed to restore the properties of the components and to relieve residual stresses within the material. Such cracks may extend beyond the heat affected zone through the weld metal or through the parent material. During heat treatment, as residual stress is relaxed, precipitation of $Ni_3(Al,Ti)$ occurs rapidly, resulting in volume contraction and strengthening of the material, thereby resulting in a reduction of the ductility of the material. Cracking occurs when the strain associated with stress relaxation exceeds the strain capacity of the heat affected zone. Hot cracks may act as the initiation points for strain age cracks.

The strain-age cracking tendency of superalloys is related to the total amount of alloying elements such as Al and Ti contained within the alloy.

Presently used methods to minimize strain age cracking include solution and overaging pre weld heat treatments. The former method works well with alloys with low $Ni_3(Al,Ti)$ volume percents, while the latter method works best for materials with high $Ni_3(Al,Ti)$ volume percent. Such heat treatment typically involves heating the entire component in a vacuum furnace to a predetermined temperature and cooling the component to room temperature, with the cooling done quickly or slowly depending on the desired result. A typical hold temperature is the solution temperature where all the $Ni_3(Al,Ti)$ precipitates go into solution.

In the case of directionally solidified or single crystal materials, the heat treatment hold temperature is limited to temperatures that are lower than the solution temperature due to recrystallization (formation of new small grains) within the material. Formation of recrystallized grains results in a reduction of the desired mechanical properties of the material. However, such low temperature heat treatment is insufficient to improve the weldability of the material.

Accordingly, there is a need for a method of heat treating superalloys in a manner that improves the weldability of the portion of the component to be repaired without damaging the microstructure and material properties of the remainder of the superalloy component. Such a method would substantially reduce the cost of maintaining equipment using superalloy components by improving the repairability of these components, and avoiding the expense of replacement of damaged components.

SUMMARY OF THE INVENTION

The present invention provides an improved method of heat treating superalloy components. The method includes performing a local pre-weld heat treatment only to the region of the component that requires repair. By using a localized heat treatment, temperatures close to, equal to, or greater than the $Ni_3(Al,Ti)$ solution temperature may be used. Such localized heat treatment will resist recrystallization in other critical areas such as, in the example of a turbine blade, the remainder of the airfoil and the root.

During localized heat treatment, the heat treated portion of the component will be taken to a temperature between about 1,850° F. and 2,400° F. This portion of the component may be allowed to cool from this temperature to approximately 1,000° F. and 1,800° F. at a controlled cooling rate. The remainder of the component will generally be kept below 1000° F. to resist alteration of the microstructure. Heat conduction through the superalloys that is being given a localized heat treatment is unlikely to be sufficient to increase the temperature of the remainder of the component above about 1,000° F. However, as an additional precaution, a cooling medium may be directed below the portion of the component being given a heat treatment, for example, directing Argon gas below the heat treated portion to carry away the heat.

The region of the components in which welding will be performed may be heat treated using well known local heat treating methods such as induction heating or resistance heating. Particular superalloys with which the present invention may be used include, but are not limited to, CM247, MarM002, IN738, and RENE 80.

Accordingly, it is an object of the present invention to provide a method of resisting cracking during weld repairs of components made from superalloy materials.

It is another object of the invention to provide a method of localized heat treatment of superalloy components.

It is a further object of the invention to maintain the microstructure and mechanical properties of the portion of a superalloy component outside the heat affected zone of a weld repair.

It is another object of the invention to maximize the lifespan and improve the repairability of components made from superalloys that are used in high-temperature, high-stress environments.

These and other objects of the invention will become more apparent through the following description and drawings.

BRIEF DESCRIPTION OF THE DRAWINGS

Like reference characters denote like elements throughout the drawings.

DESCRIPTION OF THE PREFERRED EMBODIMENTS

The present invention provides an improved method of heat treating superalloys, which resists the formation of recrystallized grains in portions of the component not being repaired, and also resists cracking during and after the welding process. Although primarily intended for use prior to welding, the heat treating method may also be advantageously used after welding, to rejuvenate components after extended service, and as a pre-brazing or post-brazing heat treatment.

Figure 1:
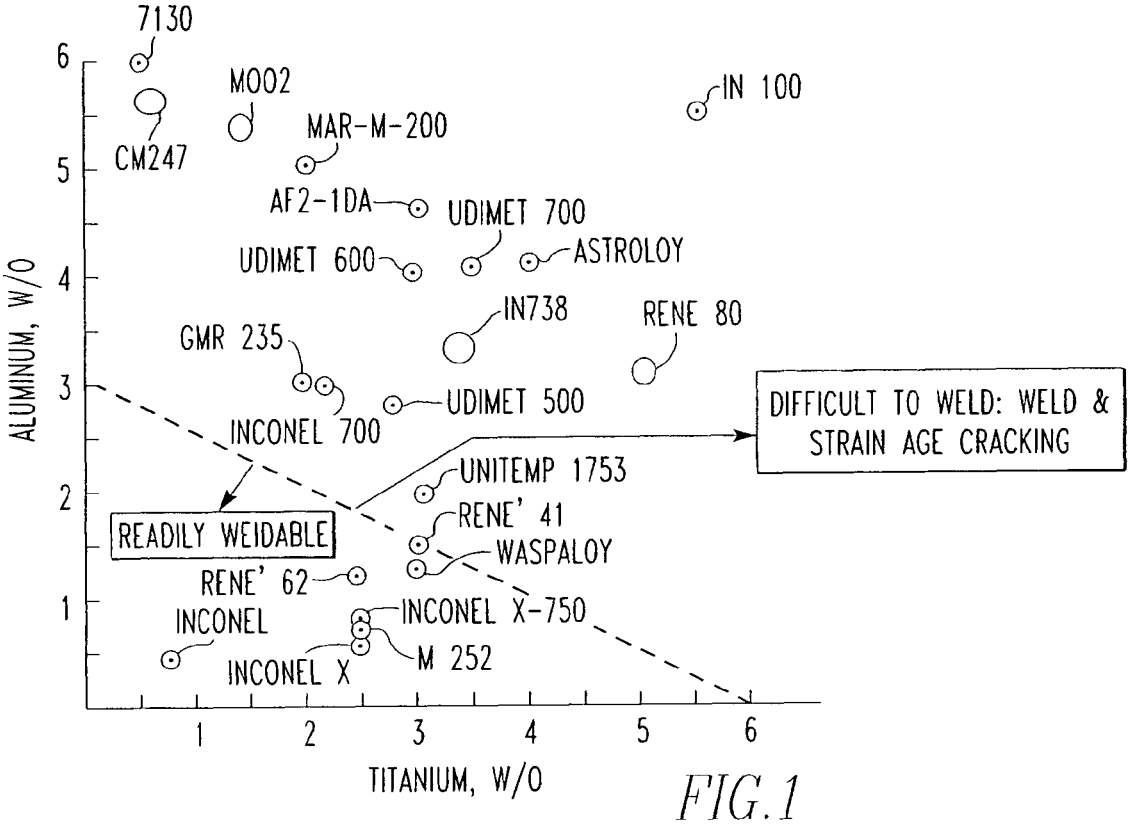
FIG. 1 is a graph illustrating the weldability of various alloys based on susceptibility to strain age cracking.

Referring to FIG. 1, the difficulty in welding various superalloys based on their aluminum and titanium concentrations is illustrated. As shown in FIG. 1, increasing concentrations of both aluminum and/or titanium in nickel based superalloys increases the difficulty of welding these materials. The graph shows that the alloys CM247, MarM002, IN738, and RENE 80 are particularly difficult to weld. All of these alloys are examples of alloys with which the present invention may be used.

Figure 2:
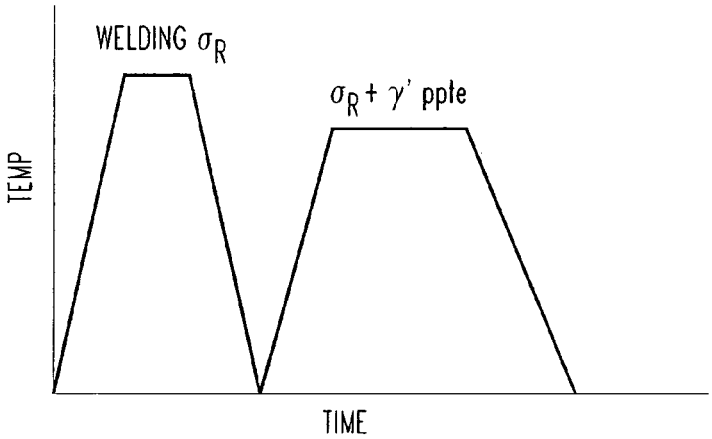
FIG. 2 is a graph indicating the typical thermal cycle involved during welding and post weld heat treatment.
Figure 3:
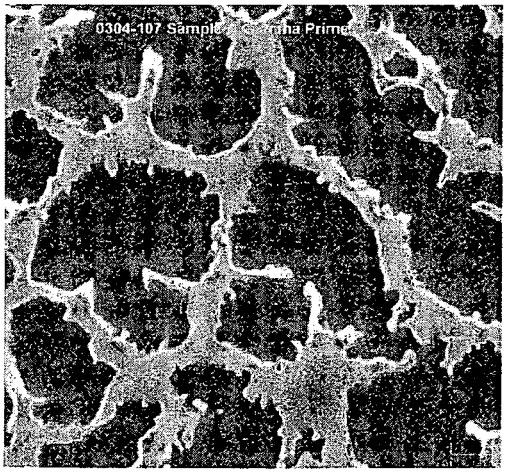
FIG. 3 is a scanning electron microscope image magnified 10,000 times illustrating the $Ni_3(Al,Ti)$ precipitate size resulting from pre-weld heat treatment with a high hold temperature.
Figure 4:
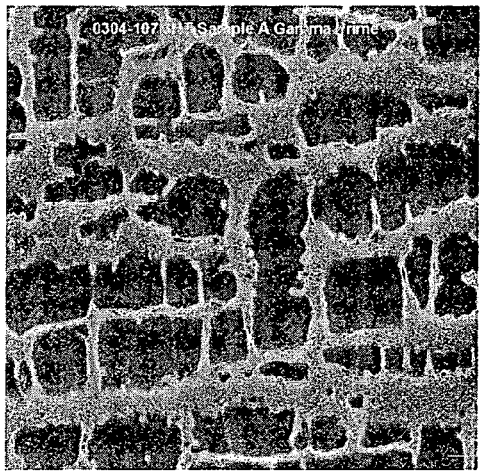
FIG. 4 is a scanning electron microscope image magnified 10,000 times showing the $Ni_3(Al,Ti)$ precipitate size resulting from pre-weld heat treatment with a low hold temperature.
Figure 6:
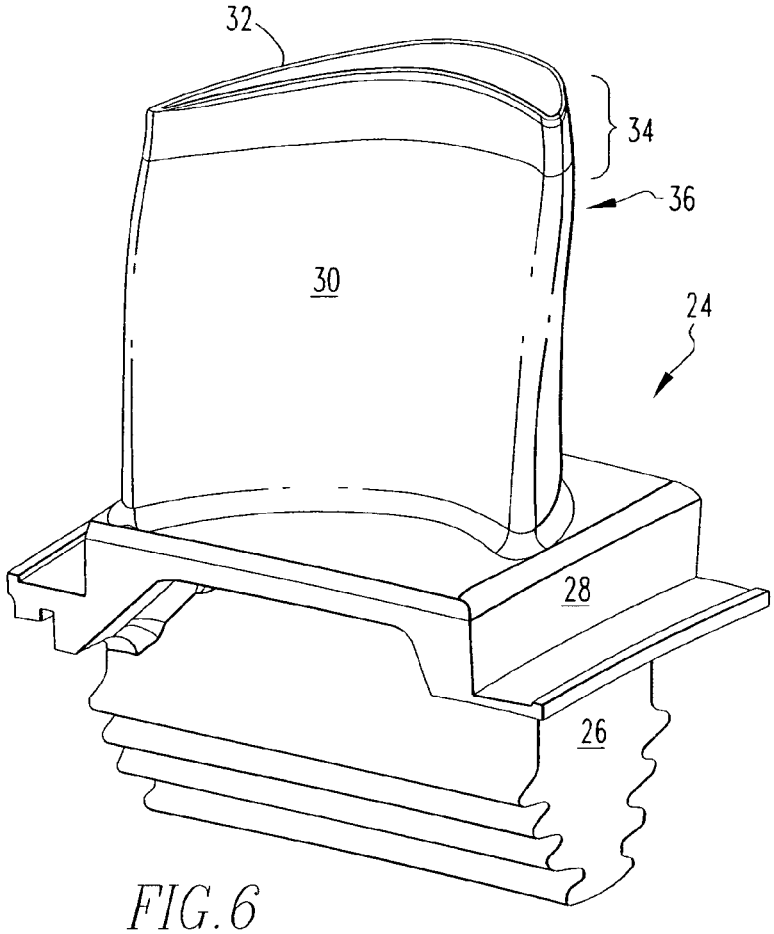
FIG. 6 is an isometric view of a blade for a combustion turbine.
Figure 7:
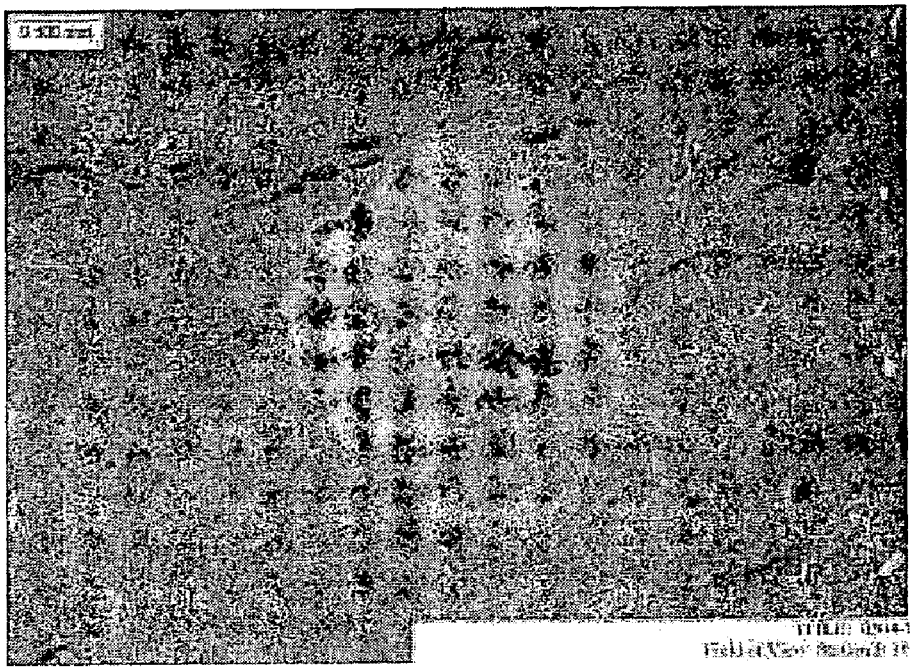
FIG. 7 is a metallograph magnified 100 times illustrating recrystallization in a directionally solidified nickel base alloy.

Referring to FIG. 2, the thermal cycle during welding and post heat treatment is illustrated. Welding subjects the material to a very high temperature for a relatively short period of time, resulting in residual stress within the material. During the post-weld heat treatment, two competing processes occur simultaneously. The desired relief of residual stresses and the undesired $Ni_3(Al,Ti)$ precipitation occur at the same time. Carbides may also precipitate out of the material. FIG. 3 illustrates the enlarged grain structure that results from high temperature heat treatment of superalloys. This grain structure is contrasted with FIG. 4, illustrating the small grain size that is desired for these superalloys. This precipitation of $Ni_3(Al,Ti)$ particles increases the strength of the material, with a concurrent reduction in ductility. The combination of the relief of residual stresses and precipitation of $Ni_3(Al,Ti)$ particles results in strain age cracks. The present invention therefore seeks to avoid the formation of recrystallized grains as shown in FIG. 6 in other areas of the component for which repair is not needed, while simultaneously preventing strain age cracking in the heat affected zone and filler metal of the weld.

Figure 5:
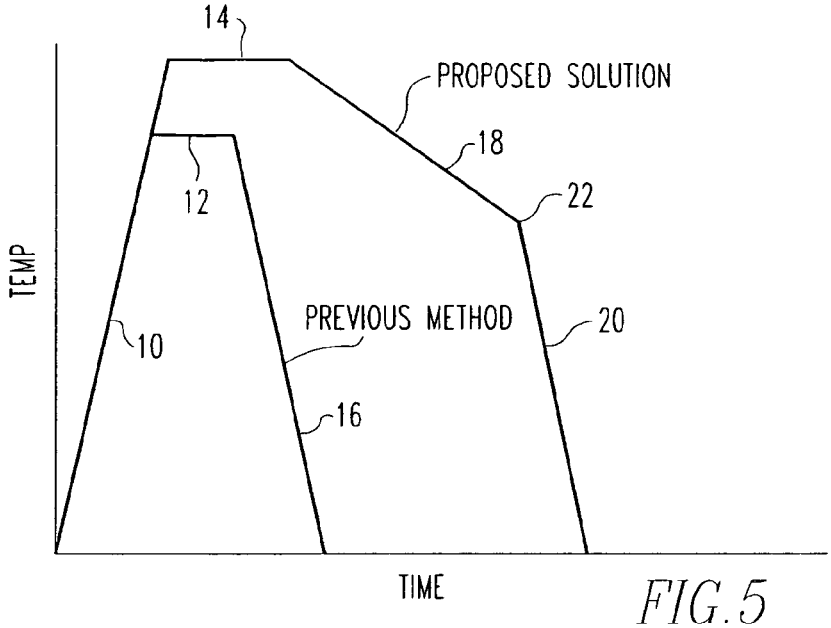
FIG. 5 is a graph illustrating the difference in temperature and time between prior whole component heat treatment and the localized heat treatment of the present invention.

FIG. 5 illustrates the pre-weld heat treating process of the present invention as compared with the previous heat treating method. Both the previous method and the present invention utilize similar heating rates, as indicated by the portion 10 of the graph. However, a previous method of heat treating the entire component used a hold temperature below the $Ni_3(Al,Ti)$ solution temperature, as indicated by graph segment 12, while the present heat treating method uses a heat treating temperature close to, at, or above the $Ni_3(Al,Ti)$ solution temperature, with the hold temperature preferably in the range of about 1,850° F. to about 2,400° F., as indicated by graph segment 14. The hold time at the desired temperature for the present invention may be approximately equal to or, if desired, longer than the hold time of the previous heat treating method, also illustrated by the line segments 12, 14. After the appropriate hold time, the previous heat treating method cools the entire component to below 1,000° F. over a short time period that may be about two hours, represented by the line segment 16. The present invention cools the component over a time period totaling about three to ten hours, represented by the combination of the line segments 18 and 20. During the initial phase of cooling, cooling is allowed to proceed slowly from the hold temperature, as indicated by the line segment 18. At the point 22, where the temperature of the heat treated material is about 1,200° F. to about 1,700° F., the component is cooled more rapidly, as indicated by the line segment 20. As is well known in the art of heat treating, the slow cooling rate represented by the line segment 18 permits for continued diffusion of the molecules within the material, while the faster cooling rate illustrated by the line segment 20 limits further diffusion of the molecules.

The region of the components in which welding will be performed may be heat treated using well known local heat treating methods such as induction heating, resistance heating, lamp heating, or other known heating methods. Basically, induction heating utilizes a copper coil with a power supply to induce eddy currents in the component, with the eddy currents generating heat. Resistance heat treatment utilizes resistance elements on or near the component being heat treated. The heat treatment may be performed in air, in an inert gas environment, or in a vacuum.

During the localized heat treatment, heat conduction through the remainder of the superalloy component is unlikely to be sufficient to raise the temperature of the remainder of the component above 1,000° F. However, a cooling medium may be directed immediately adjacent to the heat affected zone of the component being repaired, for example, directing argon gas adjacent to the heat affected zone to carry away the heat.

FIG. 6 illustrates a blade 24 of a combustion turbine, which is representative of a component that may be repaired using the present invention. The blade 24 includes a root depending downward from a platform 28. An airfoil 30 extends upward from the platform 28. When the blade 24 is installed within a turbine, the root 26 will be retained by the turbine discs using a fir-tree configuration and a locking mechanism. The tip 32 of the airfoil 30 will undergo the greatest stress during use, and is therefore the most likely location for crack formation.

In such a case, after welding, only the heat affected zone 34 requires a heat treatment of the present invention, thereby preserving the metallurgy of the remainder of the blade 24. If desired, a coolant such as argon gas may be applied to the region 36 of the airfoil 30.

The present invention therefore provides an improved method of heat treating a superalloy component, wherein only a localized portion of the entire component is heat treated. The portion of the component to be repaired may therefore be given a heat treatment at a sufficiently high hold temperature to necessitate the required averaging heat treatment to prevent strain age cracking, while the remainder of the component does not undergo any heat treatment and therefore retains its original microstructure, devoid of any recrystallization. The present invention therefore improves the repairability of superalloy components used in high-temperature, high-stress environments such as the inside of a combustion turbine, thereby increasing the lifespan of these components and decreasing the cost of maintaining a combustion turbine or other equipment utilizing such superalloy components. The heat treatment may be used pre-welding, post-welding, pre-brazing, post-brazing, or for component rejuvenation. The heat treatment may be used with equiaxed materials, directionally solidified materials, or single crystal materials.

While a specific embodiment of the invention has been described in detail, it will be appreciated by those skilled in the art that various modifications and alternatives to those details could be developed in light of the overall teachings of the disclosure. Accordingly, the particular arrangements disclosed are meant to be illustrative only and not limiting as to the scope of the invention which is to be given the full breadth of the appended claims and any and all equivalents thereof.

The invention claimed is:

1. A method of locally repairing a $Ni_3(Al,Ti)$ superalloy component, the method comprising:

locally heating, in a heat zone, only the portion of the component that requires repair at a temperature close to, at, or above the $Ni_3(Al,Ti)$ solution temperature with a hold temperature of the portion of the superalloy component that requires repair in the range of 1,850° F. to 2,400° F., with a sufficiently high hold temperature to prevent strainage cracking; while the remainder of the component, not being in the heat zone, does not undergo any separate heating and retains its original microstructure devoid of any recrystallization;

performing a repair, selected from the group consisting of welding and brazing, upon the locally heated portion of the superalloy component that requires repair; and then cooling the locally heated portion of the component that requires repair from the hold temperature at two rates over a time period totaling three to ten hours, to prevent diffusion of molecules and to resist recrystallization in locations where repair is not necessary, and to resist cracking in the heat affected zone, said cooling, at a first rate, where upon reaching a cooling temperature of about 1,200° F. to 1,700° F., the portion of the component that requires repair is cooled at a second rate more rapidly than at the first rate; where at the slower first rate continued diffusion of molecules is permitted while at the more rapid second rate further diffusion of the molecules is limited, wherein the superalloy component is an equiaxed material, a directionally solidified material, or a single crystal material, cooling is by a gas cooling medium directed immediately adjacent the heat zone, to carry away heat, and the superalloy component is a blade of a combustion turbine.

2. The method according to claim 1, wherein the cooling is by a gas medium and the medium is argon gas.

3. The method according to claim 1, wherein the localized heating of the portion of the-component that requires repair is performed in air.

4. The method according to claim 1, wherein the localized heating of the portion of the component that requires repair is performed in a chamber that is filled with inert gas.

5. The method according to claim 1, wherein the localized heating of the portion of the component that requires repair is performed in a vacuum.

6. The method of claim 1, wherein the locally heated portion of the superalloy component that requires repair is cooled from the hold temperature at a first rate between about 0.5° F./min. to about 5° F./min., to a second rate to result in temperatures in the range of about below 1,000° F.

7. The method of claim 1, wherein the superalloy component is the tip of an airfoil of a combustion turbine blade, and wherein only a localized portion of the entire component is heat treated, so that the portion of the component to be repaired is given a heat treatment at a sufficiently high hold temperature to necessitate the required averaging heat treatment to prevent strain age cracking, while the remainder of the component does not undergo any heat treatment and therefore retains its original microstructure, this being effective to improve the repairability of the superalloy component.

* * * * *